US006231166B1

(12) United States Patent
Kawai et al.

(10) Patent No.: US 6,231,166 B1
(45) **Date of Patent: *May 15, 2001**

(54) INK JET HEAD

(75) Inventors: Jun Kawai; Hiroshi Sugitani, both of Tokyo; Masami Kasamoto, Ayase; Tsuyoshi Orikasa, Murayama; Hiroyuki Ishinaga, Tokyo; Teruo Arashima; Masaaki Izumida, both of Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/607,550

(22) Filed: Feb. 27, 1996

Related U.S. Application Data

(63) Continuation of application No. 08/280,981, filed on Jul. 27, 1994, now abandoned.

(30) Foreign Application Priority Data

Jul. 29, 1993 (JP) ..... 5-188355

(51) Int. Cl.[7] ..... B41J 2/05

(52) U.S. Cl. ..... 347/63; 347/56; 347/64; 347/65

(58) Field of Search ..... 347/63, 64, 65, 347/56

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/57 |
| 4,412,224 | 10/1983 | Sugitani | 347/65 |
| 4,437,100 | 3/1984 | Sugitani et al. | 347/65 X |
| 4,438,191 * | 3/1984 | Cloutier | 347/63 X |
| 4,459,600 | 7/1984 | Sato et al. | 347/56 |
| 4,463,359 | 7/1984 | Ayata et al. | 347/56 |
| 4,521,787 | 6/1985 | Yokota et al. | 347/65 |
| 4,532,530 * | 7/1985 | Hawkins | 347/64 X |
| 4,558,333 | 12/1985 | Sugitani et al. | 347/65 |
| 4,609,427 | 9/1986 | Inamoto et al. | 347/65 X |
| 4,666,823 | 5/1987 | Yokota et al. | 347/65 X |
| 4,683,481 * | 7/1987 | Johnson | 347/65 |
| 4,723,129 | 2/1988 | Endo et al. | 347/56 |
| 4,740,796 | 4/1988 | Endo et al. | 347/56 |
| 5,175,565 | 12/1992 | Ishinaga et al. | 347/67 X |
| 5,485,185 * | 1/1996 | Sueoka et al. | 347/64 |

FOREIGN PATENT DOCUMENTS

| | | | |
|---|---|---|---|
| 0109756 | 5/1984 | (EP) | B41J/3/04 |
| 0154515 | 9/1985 | (EP) | B41J/3/04 |
| 0314388 | 5/1989 | (EP) | B41J/3/04 |
| 59-123670 | 7/1984 | (JP) | B41J/3/04 |
| 59-138461 | 8/1984 | (JP) | B41J/3/04 |
| 60-64855 * | 4/1985 | (JP) | B41J/3/04 |
| 63-202455 * | 8/1988 | (JP) | B41J/3/04 |
| 5-112006 * | 5/1993 | (JP) | B41J/2/05 |

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

An ink jet head having a plurality of heat generating resistive elements arranged in an array for discharging ink, includes a base board having said heat generating resistive elements and a plurality of layers for electrical insulation or protection laminated on a substrate and liquid paths on said base board corresponding to said heat generating resistive elements.

At least a part of said layers is removed between said heat generating resistive elements adjacent to each other.

3 Claims, 7 Drawing Sheets

INK JET HEAD

This application is a continuation, of application Ser. No. 08/280,981, filed Jul. 27, 1994, now abandoned.

BACKGROUND OF THE INVENTION

1. Field of the Invention

The present invention relates to an ink jet head, and an ink jet recording apparatus which uses such head.

2. Related Background Art

In the conventionally known ink jet head, means for generating energy is arranged on the liquid paths for discharging ink, while the ink supplied to a liquid chamber is induced from an ink tank or the like to the above-mentioned liquid paths through an ink supply outlet. Here, the energy is generated and given to the ink by means for generating energy, thus discharging the ink from the discharge ports. The discharged ink droplets impact upon a recording medium to form pixels for recording. Of such ink jet heads, the one which utilizes thermal energy for discharging a recording liquid (ink) is capable of forming a plurality of discharging ports in a high density. Therefore, in addition to the capability to record in a high resolution, a head of the kind has an advantage that the head can be easily fabricated compactly as a whole.

In the conventional ink jet head which utilizes the thermal energy, a structure is generally arranged so that such a high density is attained by arranging a plurality of heat generating resistive elements on a substrate made by such as silicon, and also, using a base board having a common layer of heat accumulation and an electrically insulated layers.

FIG. 11 is a view schematically showing the cross-section of an ink jet head of such a structure represented as a background art.

In FIG. 11, a reference numeral 1 designates an alumina substrate; 2*a*, a heat accumulation layer; 2*b* and 2*c*, electrically insulated layers, respectively; 3, the heat generating resistive elements; 3*a*, electrode wiring to supply electric power to the heat generating resistive elements 3; and 4, a protective film against cavitation.

On a heater board (hereinafter may be referred to as laminated circuit base board) 100 structured as above, a ceiling board 400 grooved to form liquid paths 401 and others is joined together to constitute an ink jet head.

As a result, when the heat generating elements are energized to execute discharges, the heat thus generated is not necessarily used for discharging only, but a part of it is released to the liquid paths adjacent thereto through the aforesaid base board and others.

With a head of such a structure, the volume of discharged ink droplet becomes comparatively large because the generated heats themselves give influence to each other when ink is discharged from all the discharge ports at a time, that is, the aforesaid plural heat generating resistive elements are energized at a time to generate heat. On the other hand, when a heat generative resistive element is energized to generate heat individually, the discharging volume becomes comparatively small as compared with the above-mentioned situation. As a result, in a case where a heat generating resistive element is driven individually, it is necessary to make an arrangement so that the element can generate thermal energy in an intensity greater than usual if the same discharging volume should be obtained as in the full discharge. In other words, the difference occurs in the foaming efficiency depending on the energy to be given, necessitating an adjustment of the discharging volumes at the time of an individual discharge and a full discharge. Thus the configuration of electric power-supply becomes inevitably complicated. If the volume of the full discharge is made a standard without any adjustment, the individual discharging volume tends to be insufficient, leading to a significantly inferior quality of a recorded image.

FIG. 12 is a line diagram showing the relationship between the voltage P applied to the head and the discharging volume Vd.

As clear from FIG. 12, there is a great difference in the discharging volumes of individual and full discharges particularly in the electric power $P'_{TH}$ when the discharge begins. This difference takes place in spite of the fact that the electric power is equally required for both of them to obtain the temperature good enough to create film boiling in ink. This is due to the difference in the heat accumulation in the foaming portions after the heat generating resistive elements generate heat. When a discharge is made only from an individual nozzle, the heat radiation is greater to the adjacent liquid paths and others, and before the size of the maximum foaming becomes large enough, the defoaming occurs, while in a case where a plurality of heat generating resistive elements are driven at a time such as a full discharge, the heat radiation to the adjacent liquid paths and others is not so great, and the size of foaming becomes large enough accordingly.

In other words, it is necessary to apply an electric power equivalent to the $P'_{OP}$ which is greater than the $P'_{TH}$ as shown in FIG. 12 in order to obtain the same discharging volume for the individual discharge and the full discharge in the conventional head.

SUMMARY OF THE INVENTION

The present invention is designed in consideration of the conventional art and the related background art as described above. It is an object of the invention to provide an ink jet head and ink jet recording apparatus capable of executing stabilized discharges with a small amount of energy given for the provision of images of a high quality by improving the layer structures in consideration of the heat transfer between the adjacent heat generating resistive elements on the layers constituting the laminated circuit base board.

In order to achieve such an objective, the major condition required for the present invention is that in an ink jet head having a plurality of heat generating resistive elements arranged in an array to discharge ink, there are provided a base board on which plural layers are laminated on a substrate in order to electrically separate or protect the aforesaid heat generating resistive elements and each of the heat generating resistive elements, as well as liquid paths arranged on the base board with respect to the heat generating resistive elements, and that an ink jet head is characterized in having at least a removed part in the aforesaid layers between the adjacent heat generating resistive elements or an ink jet head cartridge having such a head and an ink tank together or a recording apparatus having such ink jet head.

With the structure described above, it is possible to suppress the transfer of heat generated on the liquid path to the parts other than such liquid path by adjusting the layer structure of the plural layers constituting the laminated circuit base board in the regions which provide boundaries between the liquid paths serving as heat generating chambers.

DETAILED DESCRIPTION OF THE PREFERRED EMBODIMENTS

Hereinafter, in conjunction with the accompanying drawings, the detailed description will be made of the embodiments according to the present invention.

Figure 1:
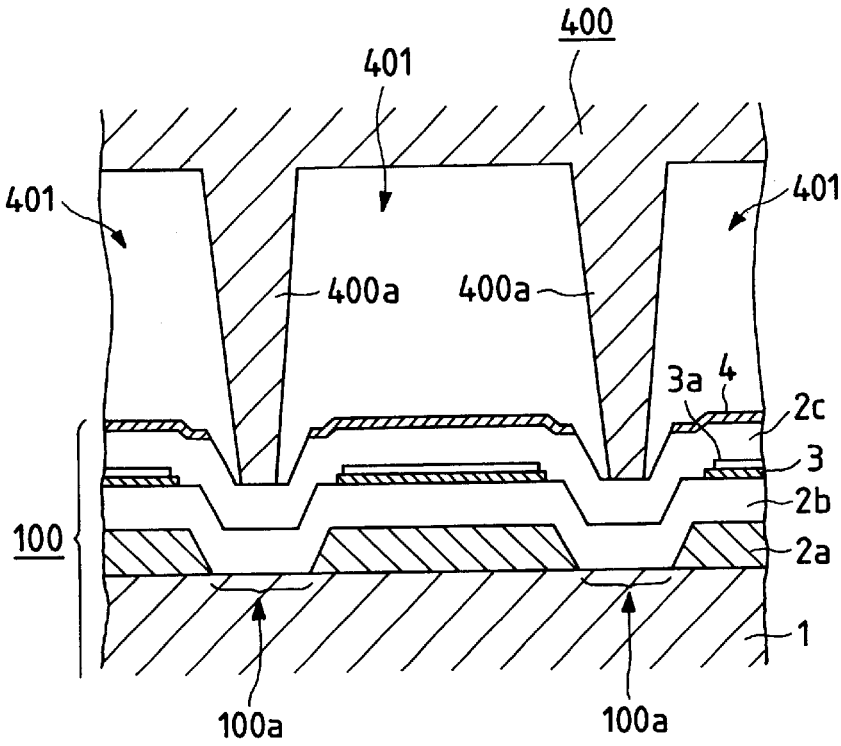
FIG. 1 is a view schematically showing the cross-section of an ink jet head according to an embodiment of the present invention.

FIG. 1 is a view schematically showing the cross-section of the arrangement direction of an electrothermal transducer on the laminated circuit base board of an ink jet head according to a first embodiment of the present invention.

In FIG. 1, a reference numeral 1 designates a substrate made of alumina, silicon, or the like; 2*a*, a heat accumulation layer formed by silicon or the like, which dually serves as an electrically insulating layer; 2*b* and 2*c*, electrically insulating layers formed by silicon oxide, silicon nitride, or the like for electrically separating or protecting each of the plural heat generating resistive elements in the vicinity thereof, respectively; 3, heat generating resistive elements formed by hafnium boride, tantalum nitride, or the like. On the heat generating resistive elements 3, electrode wirings 3*a* made of aluminum or the like are formed except on the portions which become the heat generating sections. The heat generating resistive elements 3 and electrode wirings 3*a* thus formed constitute the electrothermal transducers. Here, a reference numeral 4 designates a protective film formed by tantalum or other metal, which is provided to be against cavitation. With each of the layers thus arranged, the heater board 100 is structured as a laminated circuit base board.

On the heater board 100, there is provided a ceiling board 400 having a plurality of partition walls 400*a* and others integrally formed to provide liquid paths 401 and others to constitute an ink jet head together with the heater board.

In the present embodiment, the base board is formed by the laminated circuits prepared in such a manner that in the portions between liquid paths of the first insulating layer 2*a* serving as the heat accumulation layer, and the protective layer 4 against cavitation of the layers 100*a* constituting each of the layers between the heat generating resistive elements, the portions are removed in a length longer than that of the direction of liquid paths of the heat generating resistive elements in the direction along the liquid paths crossing the arrangement direction of the heat generating resistive elements (in FIG. 1, the cross-section of only this part is represented).

More specifically, the size of the heat generating section (where no electrode wiring 3*a* is arranged) of the heat generating resistive element is arranged to be 40 $\mu$m wide, 105 $\mu$m long, and 0.05 $\mu$m thick. In this case, the thickness of the first insulating layer 2*a* is 1.5 $\mu$m. The width of the removed portion is 20 $\mu$m, and the length thereof is 400 $\mu$m. Likewise, the thickness of the film against cavitation is 0.2 $\mu$m, the width of the removed portion is 20 $\mu$m, and the length thereof is 400 $\mu$m.

Figure 2:
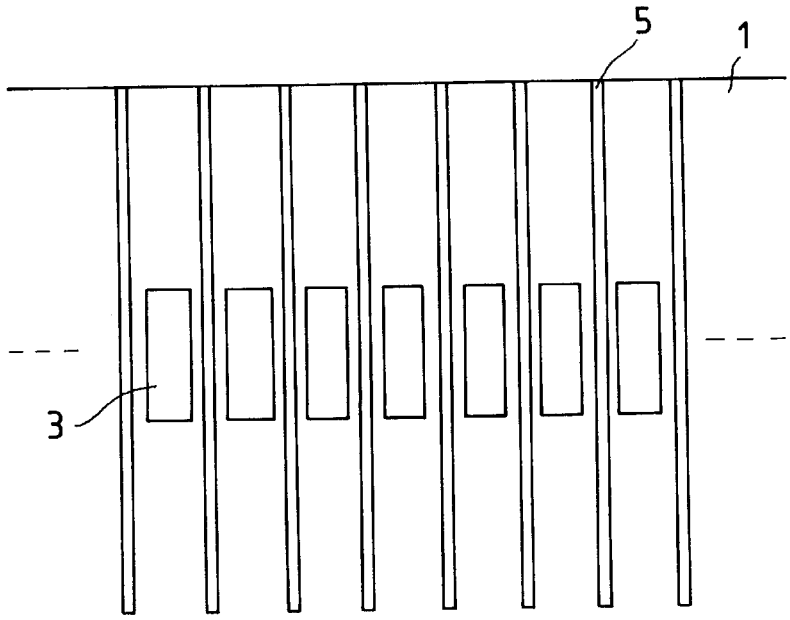
FIG. 2 is a view partially showing the structure of a base board according to the present invention.

FIG. 2 is a view showing the vicinity of the discharge ports of such a base board observed from the above.

As shown in FIG. 2, the first insulating layer is removed by use of a dry etching, a wet etching, or the like in the direction intersecting the arrangement direction of the heat generating resistive elements (in the present embodiment, the direction rectangular to the arrangement direction). (The extruded parts formed by this removal are designated by a numeral 5 in FIG. 2).

The ink jet head of the present embodiment is installed on a recording apparatus for recording. As a result, a high-quality recording is obtained at a low electric power (approximately 3.5 W) even in a case of the individual discharges.

Figure 3:
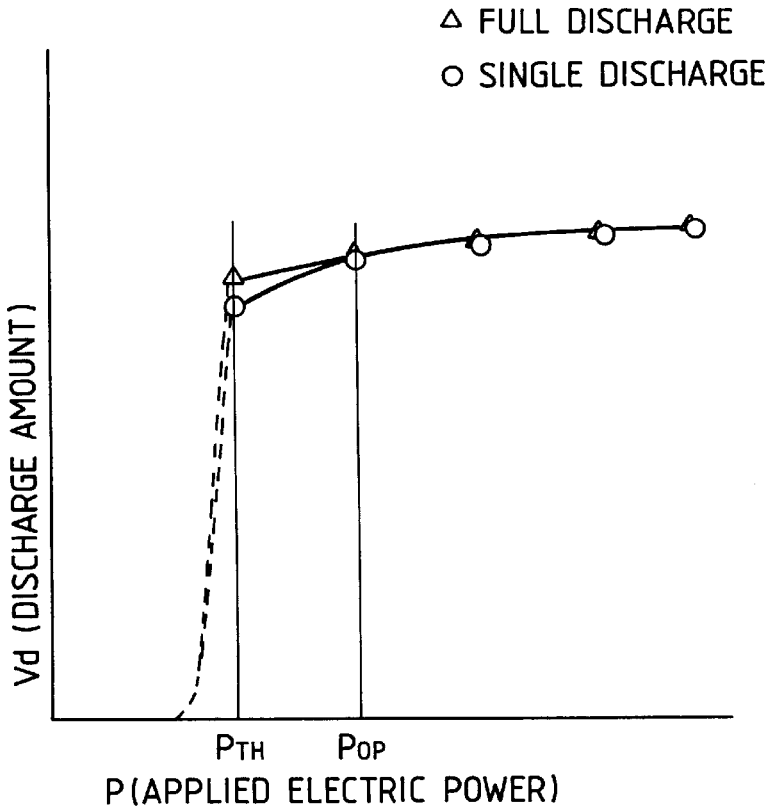
FIG. 3 is a line diagram showing the relationship between the applied electric power and the discharge amount.

FIG. 3 is a line diagram showing the discharge amount Vd with respect to the electric power P applied to an ink jet head according to the present embodiment.

As clear from FIG. 3, substantially the same characteristics are shown in a case of the full and individual discharges, and compared to the conventional ink jet head, the thermal efficiency is extremely improved.

This is due to the fact that the inclusion of heat transferring elements to the adjacent liquid paths is reduced quantitatively by removing the layer 4 provided against cavitation and the first insulating layer 2*a* between the adjacent heat generating resistive elements. In this way, it is possible to avoid the unwanted heat radiation so that a sufficient thermal efficiency is produced even in the individual discharges.

In the present embodiment, the removed portions extendedly exist between the heat generating resistive elements in the direction intersecting the arrays of heat generating resistive layer. However, it is preferable to made its length approximately two times the lengths of the heat generating resistive element with the arrays of the heat generating resistive element as the center or more preferable to make it approximately five times the length of the heat generating resistive element.

Also, in the present embodiment, the description has been made of a head of the mode in which the ink is discharged in the direction along the heat generating resistive elements, but the present invention is applicable to a head of the mode in which the ink is discharged to the side opposite to the surface having the heat generating resistive elements arranged on it.

Figure 4:
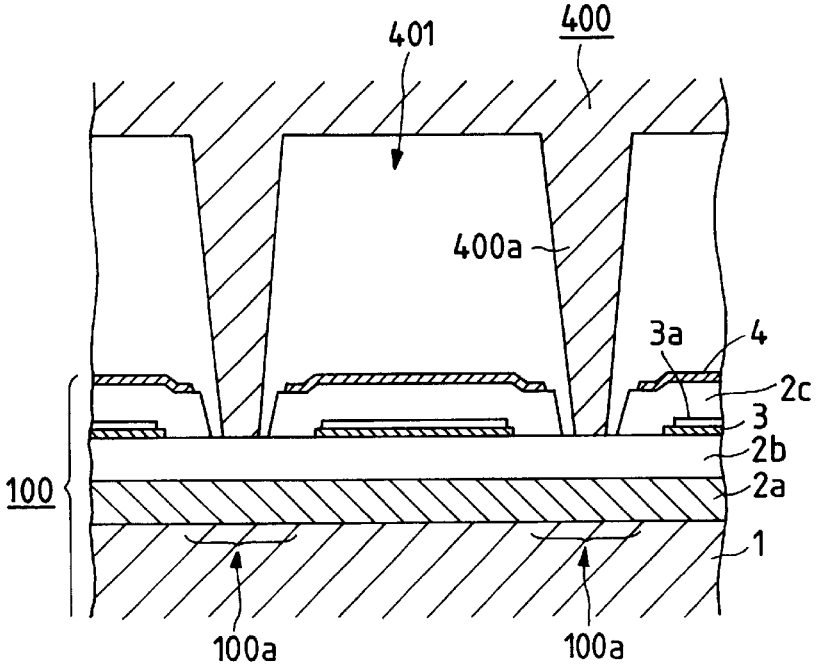
FIG. 4 is a view schematically showing the cross-section of an ink jet head according to another embodiment of the present invention.

FIG. 4 is a view schematically showing the cross-section of the laminated circuit base board of another embodiment according to the present invention.

In the present embodiment, the layer 4 against cavitation and a third insulating layer 2*c* of the layer 100*a* are removed in a size of 20 μm wide and 400 μm long between each of the heat generating resistive elements in the same layer structure as the first embodiment.

With the ink jet head of the present embodiment installed on a recording apparatus, a recording is executed. As a result, a high-quality recording is obtained at a low electric power (approximately 3.5 W).

Also, the discharge amount Vd with respect to the applied electric power P is measured. As in the first embodiment, it is clear that the thermal efficiency is better than that of the conventional ink jet head.

Figure 5:
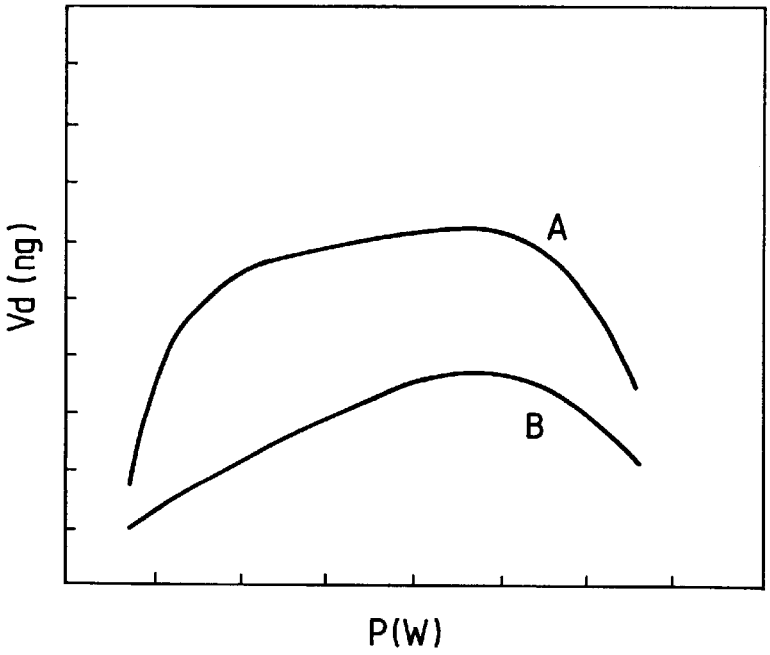
FIG. 5 is a view showing the relationship between the applied electric power and the discharge amount.

FIG. 5 is a view showing a line indicating the changes of the discharge amount Vd with respect to the driving electric power P (w) when the head of the present invention is driven (line A), and the line B is a comparison prepared by removing only the film against cavitation in a size of 20 μm wide and 400 μm long between the heat generating resistive elements. Since the film thickness of the film against cavitation is smaller than those of the other layers. In other words, since the heat capacity of this film is small, its heat transfer in the direction to other heat generating resistive elements is not so great fundamentally. Therefore, any significant effect can not be anticipated just by removing a part of this film. In contrast, if the insulating layer is removed as in the present and other embodiments it is possible to obtain the discharge of ink in a large quantity by the application of the same driving electric power because the film thickness of the layer is larger, and the heat capacity is greater accordingly.

Figure 6:
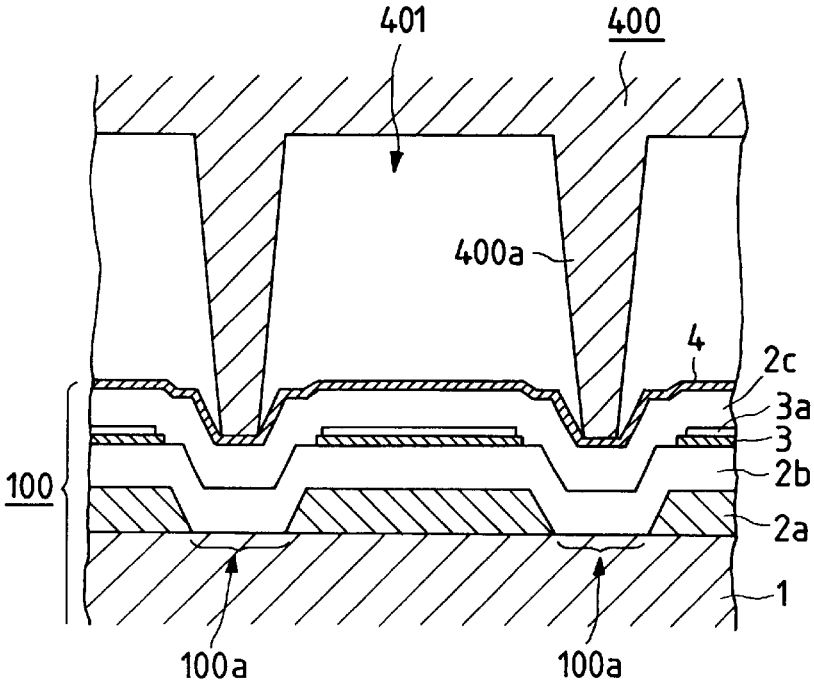
FIG. 6 is a view schematically showing the cross-section of an ink jet head according to still another embodiment of the present invention.

FIG. 6 is a view schematically showing the cross-section of a laminated circuit base board according to still another embodiment of the present invention.

In the same structure as the first embodiment, only the first insulating layer 2*a* of the layer 100*a* is removed in a size of 20 μm wide and 400 μm long between each of the heat generating resistive elements.

With the ink jet head of the present embodiment installed on a recording apparatus, a recording is executed. As a result, a high-quality recording is obtained at a low electric power (approximately 3.5 W) substantially in the same manner as each of the embodiments described above.

Also, the discharge amount Vd with respect to the applied electric power P is measured. As in each of the above embodiments, it is clear that the thermal efficiency is better than that of the conventional ink jet head.

Figure 7:
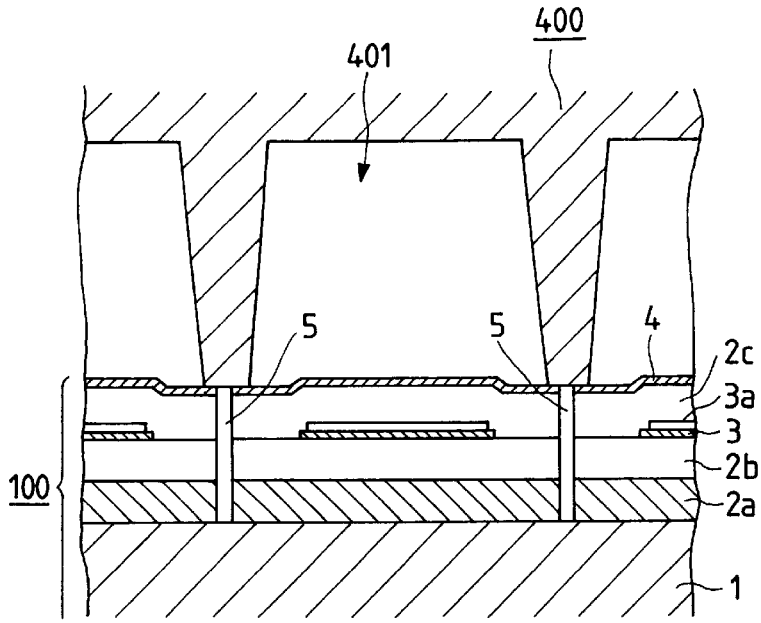
FIG. 7 is a view schematically showing the cross-section of an ink jet head according to a further embodiment of the present invention.

FIG. 7 is a view showing a further embodiment according to the present invention.

In each of the embodiments described above, the examples are shown in which a removal is provided for one of the insulating layers, but if there is no problem of electrical leak at all, it is possible to partly remove all the insulating layers, respectively, as described in the present embodiment. (In FIG. 7, the parts to be removed are designated by a reference numeral 5, while the length of the parts to be removed is defined in the same manner as the previous embodiment.)

If the recesses are formed by removing the plural layers as in the present embodiment, it is possible to prevent the thermal cross talks from taking place between the adjacent nozzles more effectively.

As described above, it should be possible to determine the numbers of layers to be removed in agreement with the degree of the rigidity in which the thermal cross talks are restricted between the adjacent nozzles. Although it is still effective if about half an insulating layer is removed, it is desirable to remove one complete layer. Also, it is more effective to remove the layer positioned closer to the heat generating resistive elements as an insulating layer to be removed.

Figure 9:
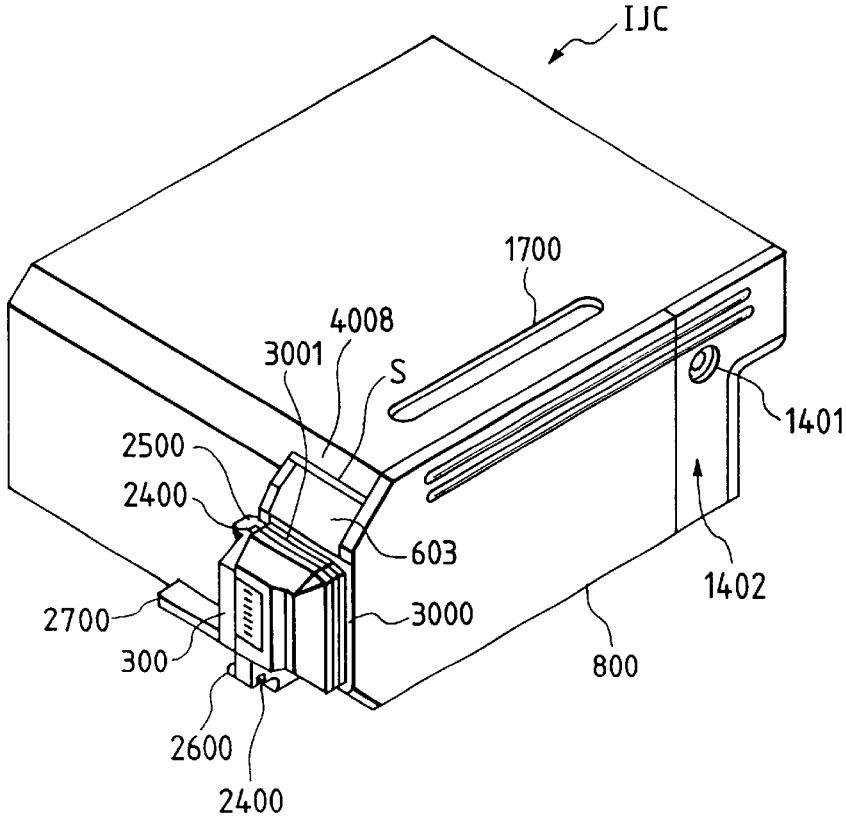
FIG. 9 is a perspective view showing the external appearance of an ink jet cartridge according to the present invention.
Figure 8:
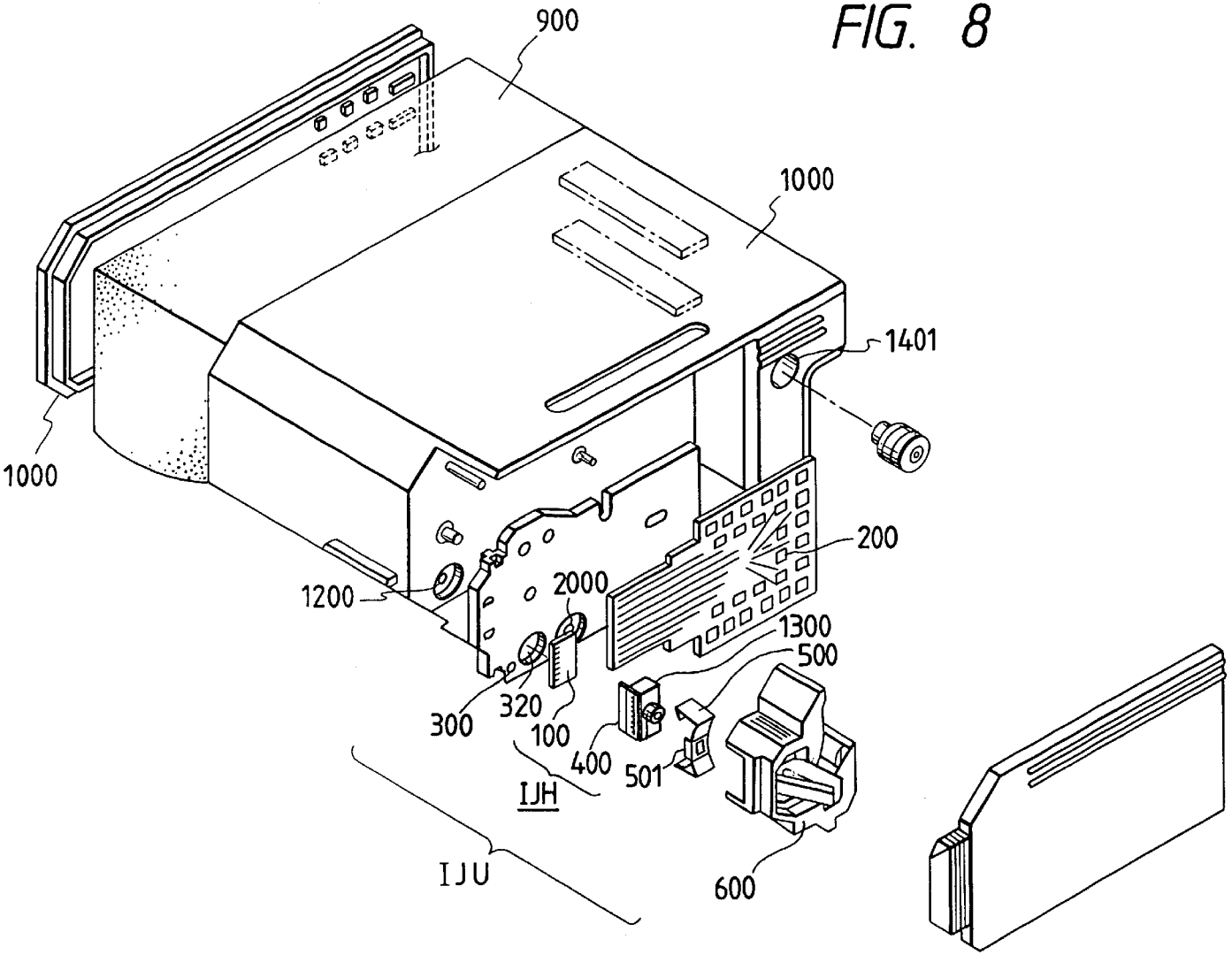
FIG. 8 is an exploded perspective view showing an ink jet cartridge according to the present invention.
Figure 10:
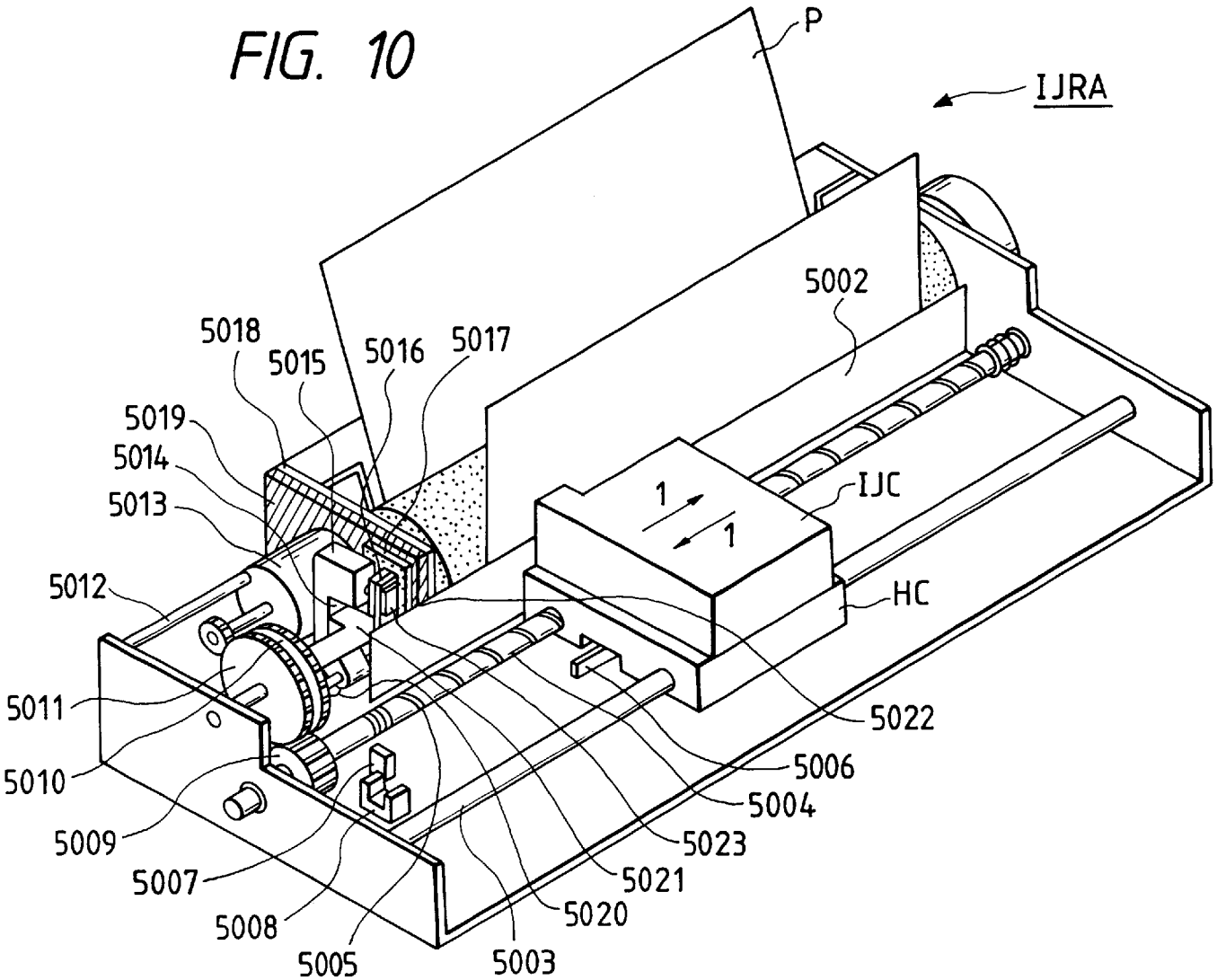
FIG. 10 is a view showing an apparatus having an ink jet head of the present invention mounted on it.
Figure 11:
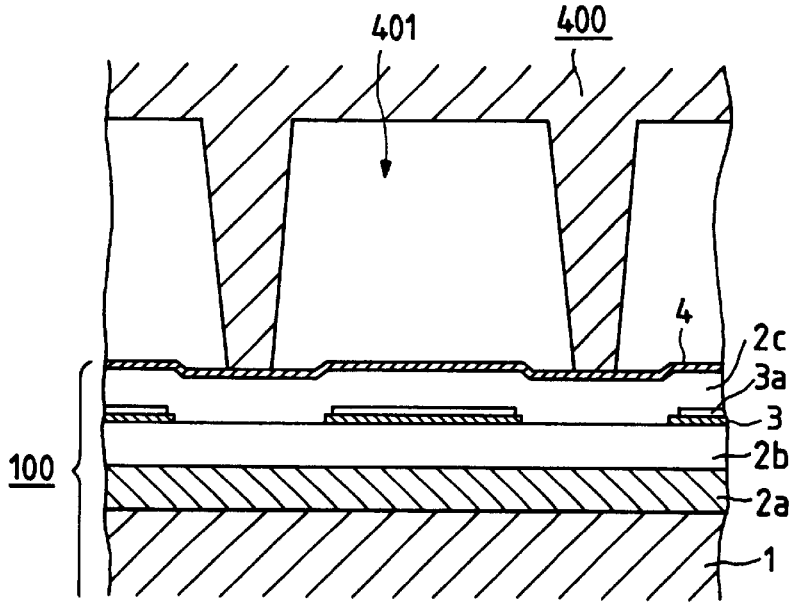
FIG. 11 PRIOR ART
FIG. 11 is a view schematically showing the cross-section of an ink jet head according to the related background art.
Figure 12:
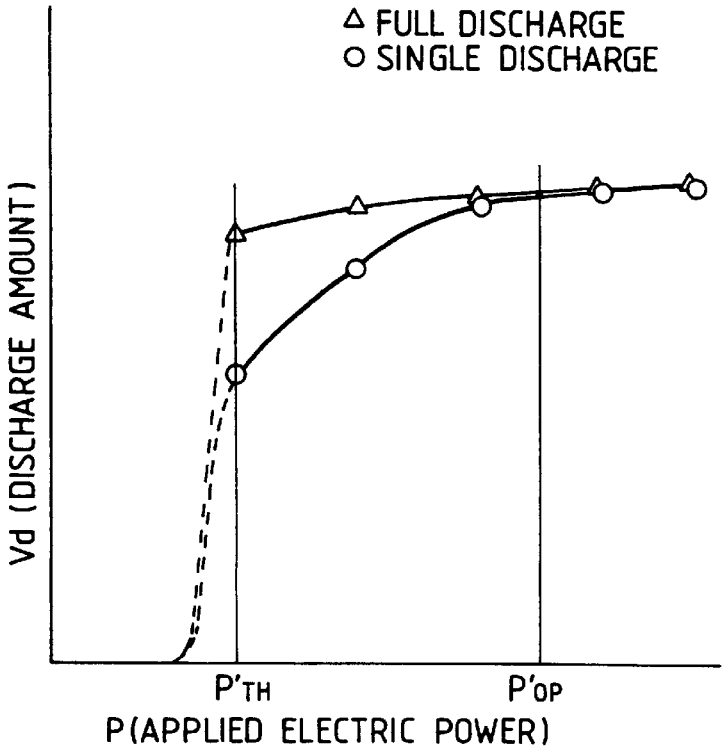
FIG. 12 PRIOR ART
FIG. 12 is a line diagram showing the relationship between the applied electric power and the discharge amount.

Now, FIG. 8 to FIG. 10 are views showing a preferable ink jet unit IJU for which the present invention is implemented or suitably used, an ink jet head IJH, an ink jet cartridge IJC, and the main body of an ink jet recording apparatus IJRA, respectively. Hereinafter, with reference to FIG. 8 to FIG. 10, the structure of each part will be described.

As clear from FIG. 9 which illustrates an ink jet cartridge of the present embodiment in perspective, the cartridge is formed integrally with an ink jet head and an ink tank. The ratio of the ink storage is greater in it. This ink jet cartridge IJC is fixedly supported by means for positioning the carriage installed on the main body of an ink jet recording apparatus IJRA, and by the electrical contacts. Also, this cartridge is made disposable, and it can be attached to and detached from the carriage.

The ink jet unit IJU is the unit of a bubble jet type in which electrothermal transducers are used for the generation of thermal energy in order to create film boiling in ink in response to electric signals.

In FIG. 8, a reference numeral 100 designates a heater board (first substrate). There are formed by a film formation technique on this board the electro-thermal transducers (discharge heater) arranged in a plurality of lines on the Si substrate, and Al and other electric wirings to supply electric power to them; and 200, a printed circuit board for the heater board 100.

A reference numeral 1300 designates a grooved ceiling board comprising the partition walls (grooves) to separate a plurality of ink liquid paths, a common liquid chamber to contain ink for distributing it to each of the ink paths (liquid flow passages), and others. This board is integrally formed with an orifice plate 400 having a plurality of discharge ports corresponding to each of the ink paths. Although polysulfone resin should be preferable as a material for the integral formation of these elements, it may be possible to use some other resin material for its formation.

A reference numeral 300 designates a metallic support, for example, which supports flatly the reverse side of the printed circuit board 22, and serves as a bottom plate of the ink jet unit; 500, a pressure member comprising a pressure bar spring shaped in the M-letter form whereby to lightly press the common liquid chamber with the central part of the M-letter form, and at the same time, to press a part of liquid paths with the apron 501 of this bar spring. Here it is preferable to press the area in the vicinity of discharge ports by linear pressure intensively. The foot portions of pressure bar spring are coupled with the reverse side of the support 300 through the hole 3121 of the support 300 so that the heater board 100 and the ceiling board 1300 are coupled while being pinched by them. In this way, the heater board 100 and ceiling board 1300 are pressed and fixed by the biasing force exerted intensively by the pressure bar spring 500 and its apron 501.

The ink tank comprises the main body 1000 of a cartridge, an ink absorbent 900, and a cover 1100 which seals the mounting surface of the main body of the cartridge 1000 for the unit IJU after the ink absorbent 900 is inserted into it from the side end of the opposite side. A reference numeral 1200 designates an outlet for supplying ink to the unit IJU; and 1401, an air communicating aperture provided for the cover in order to communicate the interior of the cartridge with the atmosphere.

Here, in the present embodiment, polysulfone, polyether sulfone, polyphenylene oxide or other resin having an excellent resistivity against ink is used for the ceiling board 1300 which is integrally molded in a metal die together with the orifice plate 400 at a time.

As described above, the integrally formed parts are the ink supply member 600, the integrated body of the ceiling board and orifice plate, and the main body of the ink tank 1000. Therefore, not only this arrangement of part formation contributes to a higher assembling precision, but also it is extremely effective in improving the quality of products when manufactured in a large scale production. Also, compared to the conventional product, the number of parts is reduced, making it possible to reliably demonstrate excellent characteristics as desired.

FIG. 10 is a general view showing an ink jet recording apparatus to which the present invention is applicable. A carriage HC has a pin (not shown) which fits in the linear groove 5004 of a lead screw 5005 interlocked with the regular and reverse rotations of a driving motor 5013. Thus, through the driving transmission gears 5011 and 5009, the lead screw rotates to reciprocate the carriage in the directions indicated by arrows a and b. A reference numeral 5002 designates a sheet pressure board to press a sheet to a platen 5000 over the direction in which the carriage travels; 5007 and 5008, means for detecting home position where the rotational direction of the motor 5013 is changed by confirming the presence of the lever 5006 of the carriage by a photocoupler in this area; 5016, a member for supporting a cap member 5022 to cap the front end of the recording head; 5015, means for sucking from the interior of the cap to perform the suction recovery of the recording head through the aperture 5023 in the cap; 5017, a cleaning blade; and 5019, a member for moving the blade forward and backward, which is supported by a supporting plate 5018 of the main body of the apparatus. The blade is not necessarily in this mode. It is of course possible to use a known blade for the present embodiment. A reference numeral 5012 designates a lever for starting a suction of the suction recovery. The lever moves along the shifting of the cam 5020 which is coupled with the carriage. This movement is controlled by a driving force of the driving motor through a known transmission means such as switching by a clutch.

These capping, cleaning, and suction recovery are structured to perform a desired processing in the respective positions arranged correspondingly by the function of the lead screw 5005 when the carriage arrives in the area on the home position side, but any structure may be applicable to the present embodiment if only a desired operation can be executed at a known timing. Each of the above-mentioned structures is an excellent invention itself whether it is considered individually or complexly, and each of the structural examples shown is preferably applicable to the present invention.

In this respect, means for supplying driving signals is provided for this apparatus in order to drive the elements which generate ink discharge pressure.

Here, particularly among the ink jet recording methods, the present invention produces an excellent effect on the recording head and recording apparatus which use a method of creating the changes of state of ink by the above-mentioned thermal energy by the provision of means for generating the thermal energy (electrothermal transducers, leaser beam, or the like) as energy to be utilized for discharging ink because by use of such method it is possible to attain a recording in a high density and precision.

Regarding the typical structure and operational principle of this method, it is preferable to adopt the method to be implemented by the application of the fundamental principle disclosed in the specifications of U.S. Pat Nos. 4,723,129 and 4,740,796. This method is applicable to the so-called on-demand type recording system as well as to a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant one to one formation of a bubble in the recording liquid (ink) corresponding to each of the driving signals. By the development and contraction of the bubble, the liquid (ink) is discharged through a discharging port to produce at least one droplet. The driving signal is preferably in the form of pulses because the development and contraction of the bubbles can be effectuated instantaneously, thus discharging the liquid (ink) with particularly quick responses. The driving signal in the form of pulses is preferably such as disclosed in the specifications of U.S. Pat. Nos. 4,463,359 and 4,345,262. In this respect, it is possible to execute an excellent recording in a better condition if the rate of the temperature increase of the heating surface is adopted as disclosed in the specification of U.S. Pat. No. 4,313,124.

The structure of the recording head may be as shown in each of the above-mentioned specifications wherein the structure is arranged to combine such discharge ports, liquid passages, and electrothermal transducers as disclosed in the specifications (linear type liquid passage or right angle liquid passage). Here, there is also included in the present invention, a structure such as disclosed in the specifications of U.S. Pat. Nos. 4,558,333 and 4,459,600 wherein the portions thermally activated are arranged in a curved area. In addition, the present invention is effectively applicable to the structure disclosed in Japanese Laid-Open Patent Application 59-123670 wherein a common slit is used as the discharging ports for plural electrothermal transducers, and to the structure disclosed in Japanese Patent Laid-Open Application 59-138461 wherein an aperture for absorbing pressure wave of the thermal energy is formed corresponding to the discharging ports. In other words, irrespective of the modes of the recording head, it becomes possible to execute a recording reliably and efficiently according to the present invention.

Further, as a full-line type recording head having a length corresponding to the maximum width of a medium which can be recorded by a recording apparatus, the present invention is particularly applicable with an enhanced efficiency because in a case of a head of the kind the influence of the amounts of heat radiation and accumulation appear greatly. For this type of recording head, it may be possible to adopt either such a system that may be structured by combining plural recording heads to satisfy the required length or by a single recording head which is integrally formed as a full-line use.

In addition, for those of the serial type as exemplified above, the present invention is also effectively applicable to a replaceable chip type recording head which is electrically connected with the main body of the apparatus, and to which the ink is supplied when it is installed in the main assembly; or to a cartridge type recording head having an ink tank integrally provided for the head itself.

Also, it is preferable to additionally provide means for recovering the recording head, and preliminarily auxiliary means as constituents of the recording apparatus according to the present invention because these additional means will contribute to making the effectiveness of the present invention more stabilized. To name them specifically, such constituents are means for capping the recording head; cleaning means; pressurizing or sucking means; preliminary heating means by electrothermal transducers or heating elements other than such transducers or by the combination of those elements; and preliminary discharge means for performing discharges other than those for recording.

Also, with respect to the kind and number of the recording head to be installed, not only it is possible to adopt the one in which only a head is provided for a monochromic recording, for example, but the one in which a plurality of heads are provided for recording in plural colors of ink, which differ from each other in the recording colors and densities. That is, in the aspect of the recording mode of a recording apparatus, too, the present invention is extremely effective in applying it not only to the recording mode which uses only black or other major color, for example, but also to a recording apparatus provided with at least either one of the recording modes using plural colors having different colors or full color by mixing colors irrespective of the recording heads being structured integrally or by a combination of a plurality of heads.

Furthermore, in the embodiments according to the present invention described above, while the ink has been described as liquid, it may be an ink material which is solidified below the room temperature but liquefied at the room temperature. Since the ink is controlled within the temperature not lower than 30° C. and not higher than 70° C. in order to stabilize its viscosity for the stable discharges in general, the ink may be such that it can be liquefied when the applicable recording signals are given. In addition, while positively preventing the temperature rise due to the thermal energy by the use of such energy as an energy to be consumed for changing states of ink from solid to liquid, or using the ink which will be solidified when left intact for the purpose of preventing the ink from being evaporated, it is possible for the present invention to adopt the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium.

Furthermore, as the mode of the recording apparatus according to the present invention, it may be possible to adopt a copying apparatus combined with a reader in addition to the image output terminal which is integrally or independently provided for a word processor, computer, or other information processing apparatus. Also, it may be possible to adopt among others a mode of a facsimile apparatus having transmission and reception functions.

Also, the head of the present invention can be incorporated in a textile printing apparatus for recording on cloths.

As described above, in consideration of the condition of thermal transfer of each of the plural layers constituting the laminated circuit base board, it is possible to suppress according to the present invention the heat transfer to the parts other than the liquid path where such heat is generated, and reduce the quantity of heat transferred to the parts other than the liquid path by improving the layer structure in the boundaries between the liquid paths which function as thermal activation chambers.

As a result, the thermal efficiency is improved with respect to the applied energy, thus making it possible to obtain a stabilized discharge amount with a small amount of applied energy even when an individual discharge is performed. In other words, the power dissipation becomes small so that the capacity of power-supply can be curtailed, while implementing a recording of a higher quality.

What is claimed is:

1. An ink jet head comprising:

a plurality of discharge ports for discharging an ink;

a plurality of liquid paths respectively communicating with said discharge ports;

a liquid path wall partitioning said plurality of liquid paths;

a plurality of heat generating elements arranged in an array;

a first insulative layer having an insulative material supporting said heat generating elements; and a second insulative layer covering said heat generating elements, wherein said first and said second insulative layers have non-continuous portions between said heat generating elements in which said first insulative layer is not continuous with said second insulative layer, and wherein said liquid path wall bridges and is in contact with said non-continuous portions.

2. An ink jet cartridge, comprising:

an ink jet head comprising;

a plurality of discharge ports for discharging an ink;

a plurality of liquid paths respectively communicating with said discharge ports;

a liquid path wall partitioning said plurality of liquid paths;

a plurality of heat generating elements arranged in an array;

a first insulative layer having an insulative material supporting said heat generating elements; and a second insulative layer covering said heat generating elements, wherein said first and said second insulative layers have non-continuous portions between said heat generating elements in which said first insulative layer is not continuous with said second insulative layer, and wherein said liquid path wall bridges and is in contact with said non-continuous portions;

an ink tank for containing the ink; and fluid communication means for supplying the ink from the ink tank to the ink jet head.

3. An ink jet recording apparatus comprising:

an ink jet head comprising;

a plurality of discharge ports for discharging an ink;

a plurality of liquid paths respectively communicating with said discharge ports;

a liquid path wall partitioning said plurality of liquid paths;

a plurality of heat generating elements arranged in an array;

a first insulative layer having an insulative material supporting said heat generating elements; and a second insulative layer covering said heat generating elements, wherein said first and said second insulative layers have non-continuous portions between said heat generating elements in which said first insulative layer is not continuous with said second insulative layer, and wherein said liquid path wall bridges and is in contact with said non-continuous portions.

* * * * *

UNITED STATES PATENT AND TRADEMARK OFFICE

CERTIFICATE OF CORRECTION

PATENT NO. : 6,231,166 B1
DATED : May 15, 2001
INVENTOR(S) : Jun Kawai et al.

It is certified that error appears in the above-identified patent and that said Letters Patent is hereby corrected as shown below:

Title page, Item [54], and Column 1, line 1,
Title, "INK JET HEAD" should read -- INK JET HEAD, CARTRIDGE AND RECORDING APPARATUS --.

Column 1,
Line 2, "continuation," should read -- continuation --;
Line 9, "such" should read -- such a --;
Line 32, "an" should be deleted;
Line 45, "and" should be deleted;
Line 46, "others" should be deleted; and
Line 52, "of" should read -- of a --.

Column 2,
Line 54, "such" should read -- such an --.

Column 4,
Line 34, "As" should read -- As is --; and
Line 49, "made" should read -- make --.

Column 5,
Line 23, "can not" should read -- cannot --.

Column 6,
Line 11, "As" should read -- As is --.

UNITED STATES PATENT AND TRADEMARK OFFICE

CERTIFICATE OF CORRECTION

PATENT NO. : 6,231,166 B1
DATED : May 15, 2001
INVENTOR(S) : Jun Kawai et al.

It is certified that error appears in the above-identified patent and that said Letters Patent is hereby corrected as shown below:

Column 10,
Line 26, "comprising;" should read -- comprising: --; and
Line 48, "comprising;" should read -- comprising: --.

Signed and Sealed this

Fourteenth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,231,166 B1
DATED : May 15, 2001
INVENTOR(S) : Jun Kawai et al.

It is certified that error appears in the above-identified patent and that said Letters Patent is hereby corrected as shown below:

Title page,
Item [75], Inventors: "Tsuyoshi Orikasa, Murayama; Hiroyuki Ishinaga, Tokyo;" should read -- Tsuyoshi Orikasa; Hiroyuki Ishinaga, both of Tokyo; --.

Signed and Sealed this

Fifth Day of November, 2002

*Attest:*

*Attesting Officer*

JAMES E. ROGAN
*Director of the United States Patent and Trademark Office*